US006323850B1

(12) United States Patent
Katakura et al.

(10) Patent No.: US 6,323,850 B1
(45) Date of Patent: Nov. 27, 2001

(54) DRIVING METHOD FOR LIQUID CRYSTAL DEVICE

(75) Inventors: Kazunori Katakura, Atsugi; Takashi Enomoto, Sagamihara; Takao Takiguchi, Tokyo; Jun Iba, Yokohama; Seishi Miura, Ebina, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/300,473

(22) Filed: Apr. 28, 1999

(30) Foreign Application Priority Data

Apr. 30, 1998 (JP) ..... 10-120656

(51) Int. Cl.[7] ..... G09G 3/36

(52) U.S. Cl. ..... 345/204; 345/87; 345/95; 345/97; 345/206; 345/210; 349/37; 349/172; 349/174

(58) Field of Search ..... 345/87, 95, 97, 345/204, 206, 210; 349/37, 172, 174

(56) References Cited

U.S. PATENT DOCUMENTS

| | | | | |
|---|---|---|---|---|
| 4,367,924 | | 1/1983 | Clark et al. | 350/334 |
| 4,941,736 | * | 7/1990 | Taniguchi et al. | 349/173 |

(List continued on next page.)

FOREIGN PATENT DOCUMENTS

| | | |
|---|---|---|
| 7-64056 | 3/1995 | (JP) . |
| WO 96/06422 | 2/1996 | (WO) . |
| WO 97/31362 | 8/1997 | (WO) . |

OTHER PUBLICATIONS

Japanese Journal Of Applied Physics; K. Miyasato et al.; "Direct Method with Triangular Waves for Measuring Spontaneous Polarization in Ferroelectric Liquid Crystals"; No. 10, Oct. 1983, pp. L661–L663.

Fukuda, A., "Invited Pretransitional Effect in AF–F Switching: To Suppress It or to Enhance It, That is My Question about AFLDCs", Dept. of Organic Materials, Tokyo Inst. of Tech., Tokyo, Japan, *Asia Display '95 Digest*, p. 61, 1995.

Chandani, A.D.L., et al., Antiferroelectric Chiral Smectic Phases Responsible for the Tristable Switching in MHPOBC, Tokyo Institute of Technology, Dept. of Organic and Polymeric Materials, O–okayama, Meguro–ku, Tokyo 152, *J.J.A.P.*, 28, L1265, 1989).

Yoshida, T., et al., "A Full–Color Thresholdless Antiferroelectric LCD Exhibiting Wide Viewing Angle with Fast Response Time", *SID 97* (*Society for Information Display 97*) *Digest*, pp. 841–844.

Saishu, T., et al., "Voltage–Holding Properties of Thresholdless Antiferroelectric Liquid Crystals Driven by Active Matrices", *SID 96* (*Society for Information Display 96*) *Digest*, pp. 703–706.

*Primary Examiner*—Bipin Shalwala
*Assistant Examiner*—Vincent E. Kovalick
(74) *Attorney, Agent, or Firm*—Fitzpatrick, Cella, Harper & Scinto

(57) ABSTRACT

A liquid crystal device of the active matrix-type having two-dimensionally arranged pixels along rows and columns is driven frame by frame. In each frame operation, a scanning selection period ($T_G$) for each selected row is divided into a first period ($t_1$) and a second period ($t_2$). In $t_1$ of a current frame ($T_{F2}$), a reset pulse is applied to a pixel concerned, and the reset pulse is set to have an absolute value of voltage identical to and a polarity opposite to those of a writing pulse voltage applied to the pixel in the previous frame ($T_{F1}$). Then, in $t_2$ of the current frame ($T_{F2}$), the pixel is supplied with a writing pulse depending on a prescribed display state of the pixel for the current frame. As a result, the reset period is shortened to favor a high-speed display and a higher resolution display.

9 Claims, 11 Drawing Sheets

U.S. PATENT DOCUMENTS

| | | | | |
|---|---|---|---|---|
| 5,321,419 | | 6/1994 | Katakura et al. | 345/97 |
| 5,469,281 | | 11/1995 | Katakura et al. | 359/56 |
| 5,471,229 | | 11/1995 | Okada et al. | 345/89 |
| 5,519,411 | | 5/1996 | Okada et al. | 345/89 |
| 5,521,727 | | 5/1996 | Inaba et al. | 359/56 |
| 5,532,713 | | 7/1996 | Okada et al. | 345/97 |
| 5,583,534 | | 12/1996 | Katakura et al. | 345/97 |
| 5,592,190 | | 1/1997 | Okada et al. | 345/89 |
| 5,597,626 | * | 1/1997 | Eguchi | 428/1 |
| 5,598,229 | | 1/1997 | Okada et al. | 348/792 |
| 5,627,559 | | 5/1997 | Tsuboyama et al. | 345/97 |
| 5,638,195 | | 6/1997 | Katakura et al. | 349/143 |
| 5,646,755 | | 7/1997 | Okada et al. | 345/97 |
| 5,657,038 | | 8/1997 | Okada et al. | 345/94 |
| 5,666,217 | * | 9/1997 | Kaneko et al. | 349/122 |
| 5,673,062 | | 9/1997 | Katakura et al. | 345/95 |
| 5,675,354 | | 10/1997 | Katakura et al. | 345/97 |
| 5,689,320 | | 11/1997 | Okada et al. | 349/135 |
| 5,717,421 | | 2/1998 | Katakura et al. | 345/101 |
| 5,719,590 | * | 2/1998 | Shimada et al. | 345/94 |
| 5,734,365 | | 3/1998 | Ohno et al. | 345/97 |
| 5,754,154 | | 5/1998 | Katakura et al. | 345/97 |
| 5,808,594 | | 9/1998 | Tsuboyama et al. | 345/89 |
| 5,815,132 | * | 9/1998 | Okada et al. | 345/95 |
| 5,815,133 | | 9/1998 | Tsuboyama et al. | 345/95 |
| 5,844,536 | | 12/1998 | Okada et al. | 345/94 |
| 5,886,678 | | 3/1999 | Katakura et al. | 345/94 |
| 6,139,927 | * | 10/2000 | Takao et al. | 428/1.26 |
| 6,175,401 | * | 1/2001 | Tanaka et al. | 349/172 |
| 6,181,310 | * | 1/2001 | Nomura | 345/97 |

* cited by examiner

DRIVING METHOD FOR LIQUID CRYSTAL DEVICE

FIELD OF THE INVENTION AND RELATED ART

The present invention relates to a driving method for a liquid crystal device allowing a high-speed drive for gradational display according to the active matrix scheme.

Various types of liquid crystal materials are used in liquid crystal display apparatus, inclusive of nematic liquid crystals, smectic liquid crystals and polymer dispersion-type liquid crystals.

Particularly, a liquid crystal device exhibiting a spontaneous polarization and bistability has been proposed by Clark and Lagerwall in U.S. Pat. No. 4,367,924, etc. As the bistable liquid crystal, a ferroelectric liquid crystal in chiral smectic C phase (SmC*) or H phase (SmH*) is generally used. In this phase, the liquid crystal exhibits bistable states, i.e., a first optically stable state and a second optically stable state, in response to an electric field applied thereto, and also a memory characteristic, i.e., a property that the resultant first or second optically stable state is retained as it is in the absence of an electric field. The liquid crystal device also quickly responds to a change in electric field and accordingly is expected to be widely utilized in the field of high-speed memory-type display apparatus.

As liquid crystal devices using a liquid crystal having a spontaneous polarization, there are also known in recent years an anti-ferroelectric liquid crystal device using a liquid crystal exhibiting two ferroelectric states and one anti-ferroelectric state (J.J.A.P., 28, L1265, 1989), and a so-called thresholdless anti-ferroelectric liquid crystal device wherein the optical axis of liquid crystal molecules is continuously changed in a plane parallel to the substrates in response to the strength and polarity of an applied electric field (Asia Display '95 Digest, P. 61, 1995).

The former anti-ferroelectric liquid crystal device effects a picture display by utilizing the stability of an alignment state possessed by the anti-ferroelectric liquid crystal. More specifically, the anti-ferroelectric liquid crystal assumes three stable states in alignment of liquid crystal molecules. In response to a voltage exceeding a first threshold, the liquid crystal is oriented to a first ferroelectric phase wherein liquid crystal molecules are aligned in a first direction or a second ferroelectric phase wherein liquid crystal molecules are aligned in a second direction depending on the polarity of the applied voltage, and in response a voltage below a second threshold which is lower than the first threshold, the liquid crystal is oriented to an anti-ferroelectric phase which is an intermediate alignment state between the first and second ferroelectric phases. If the transmission axes of a pair of polarizers disposed on both sides of the liquid crystal device are set with reference to the optical axis in the anti-ferroelectric phase, the optical transmittance through the device can be controlled to effect a picture display.

A driving method for a display device comprising the above-mentioned anti-ferroelectric liquid crystal device equipped with active drive devices or elements is disclosed in Japanese Laid-Open Patent Application (JP-A) 7-64056 which discloses a scheme wherein a writing voltage is applied to a liquid crystal placed in a ferroelectric phase or an anti-ferroelectric phase.

On the other hand, several studies have been made on active matrix drive of the above-mentioned thresholdless anti-ferroelectric liquid crystal device exhibiting high-speed responsiveness and wide viewing angle characteristic, e.g., as disclosed in the following references:

(1) "A full-color thresholdless Antiferroelectric LCD exhibiting wide viewing angle with fast response time", T. Yoshida et al., SID 97 (Society for Information Display 97) DIGEST, pp. 841–844, and (2) "Voltage-holding properties of thresholdless Antiferroelectric liquid crystals driven by active matrices", T. Saishu, et al., SID 96 (Society for Information Display 96) DIGEST, pp. 703–706.

The above-mentioned ferroelectric liquid crystal and anti-ferroelectric liquid crystal both have a spontaneous polarization and therefore cause a current (i.e., an inversion current) accompanying the inversion of the spontaneous polarization at the time of the switching of liquid crystal molecules. The inversion current flows in a direction of obstructing the external electric field, i.e., in a direction of consuming an electric charge stored in a liquid crystal capacitance via a switching device. Accordingly, there occurs no problem if all liquid crystal molecules are switched and charges consumed by an inversion current accompanying the switch are supplemented during a period of switching element being ON, i.e., during a scanning selection period, but if the switching is not completed within the scanning selection period and some liquid crystal molecules are switched in a subsequent non-selection period, the voltage applied to the liquid crystal layer is lowered by the inversion current accompanying the switching of the liquid crystal molecules. This phenomenon is explained with reference to FIG. 6.

FIG. 6 is an example of time chart for driving a thresholdless antiferroelectric liquid crystal device as described above according to a known active matrix scheme. Referring to FIG. 6, at (a) is shown a scanning signal voltage waveform applied to switching devices on an arbitrarily selected scanning signal line wherein $T_G$ represents a scanning selection period. At (b) is shown a data signal voltage waveform applied to a pixel electrode via a switching device at a certain pixel on the selected scanning signal line. At (c) is shown a voltage waveform applied to the liquid crystal layer at the pixel. At (d) is shown a transmittance change at the pixel wherein the darkest state is represented as 0% and the brightest state is represented as 100%.

At (d) of FIG. 6 is illustrated a pixel intended to display a 100% display state in a frame period $T_{F1}$ and a 0% display state in a frame period $T_{F2}$. However, as shown for a selection period $T_G$ in the frame period $T_{F2}$ at (d), if the switching to a 0% state is not completed within the selection period $T_G$, the voltage applied across the liquid crystal layer at the pixel is raised by an inversion current due to liquid crystal molecules switched in a subsequent non-selection period as shown at (c), whereby the intended 0% display is failed as shown at (d). On the other hand, if the selection period Tg is extended so as to ensure the liquid crystal switching to the 0% state as shown in FIG. 7, the frame frequency is lowered (i.e., the frame period $T_{F1}$, $T_{F2}$ . . . is increased).

SUMMARY OF THE INVENTION

A principal object of the present invention is to provide a driving method for a liquid crystal device using a liquid crystal having a spontaneous polarization capable of a high-speed drive for desired gradational display.

According to the present invention, there is provided a driving method for a liquid crystal device of the active matrix-type comprising a pair of substrates, a layer of liquid crystal having a spontaneous polarization disposed between the substrates so as to form two-dimensionally arranged pixels disposed along a plurality of rows and a plurality of columns, and a switching device disposed at each pixel so as to control a voltage applied to the liquid crystal at the pixel; the driving method comprising a frame operation including: dividing a scanning selection period for each selected row into a first period and a second period in a current frame, in the first period, applying a reset pulse to the liquid crystal at each pixel on the selected row, the reset pulse having a polarity opposite to that of a writing pulse voltage applied to the liquid crystal at the pixel in a previous frame, thereby resetting the pixels on the selected row to a first transmittance, and in the second period, applying a writing pulse of a prescribed voltage to the liquid crystal at each pixel to establish a prescribed transmittance for current frame display at the pixel.

As a result, according to the driving method for a liquid crystal device having the above-mentioned optical characteristics of the present invention, all the pixels o a selected scanning line are uniformly reset to the first transmittance in a shorter period, whereby the rewriting time can be remarkably shortened to allow a higher-speed drive.

In the present invention, the voltage value of the reset pulse may be selected for each pixel based on a display state at the pixel in a previous frame, whereby the performance of resetting to the first transmittance can be improved to allow rewriting into desired gradation levels in a shorter period.

Further, in a preferred mode of the driving method according to the present invention, a non-selection period is interposed between the first period for applying the reset pulse and the second period for applying the writing pulse, whereby the period in which a pixel is completely transformed into a state of the first transmittance can be used for scanning selection of (an)other line(s), to realize a further shorter one-frame scanning period.

In another preferred mode, the drive is performed by a frame-inversion mode in which the voltage value of the reset pulse is determined based on a display state in the previous frame and a prescribed display state in the current frame, respectively at a pixel concerned, whereby one-frame scanning period can be further shortened.

The driving method according to the present invention is preferably applied to,a thresholdless anti-ferroelectric liquid crystal device as described above, but is also preferably applicable to another type of liquid crystal device having a similar voltage-transmittance characteristic to realize a good gradational display at a high speed.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
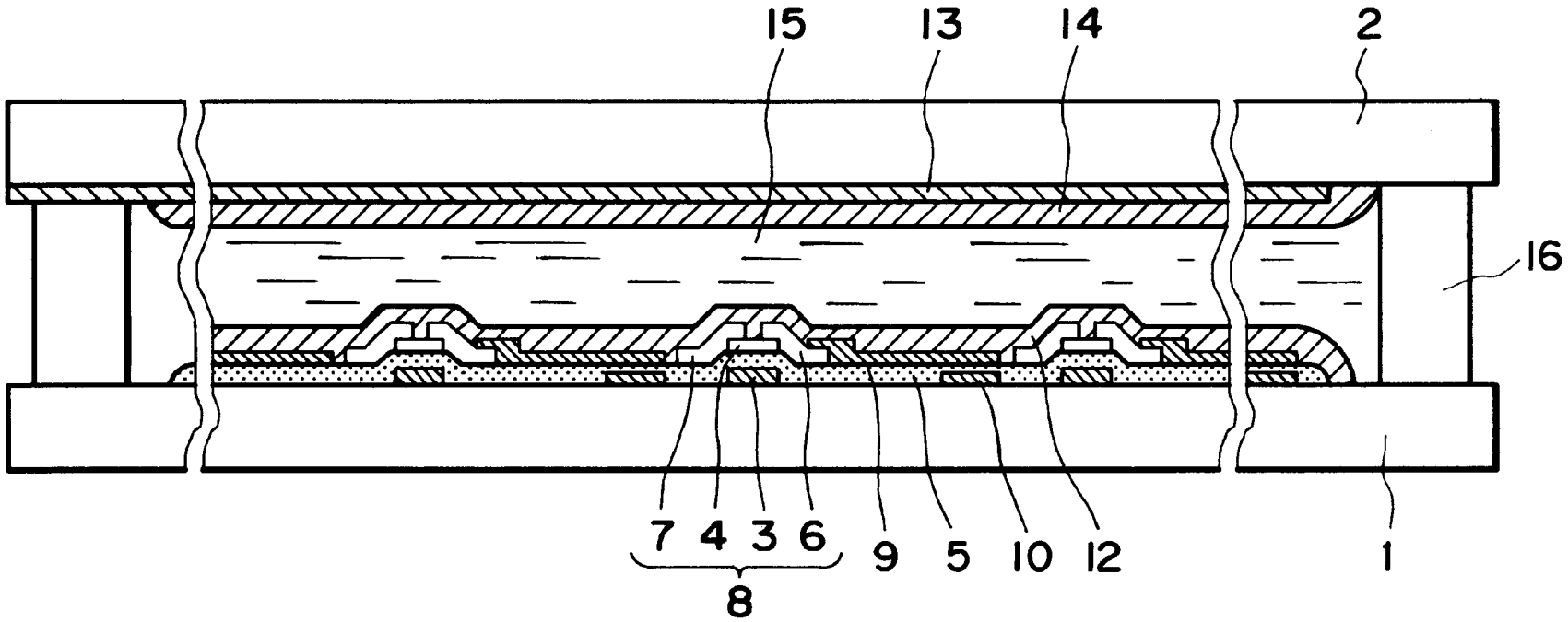
FIG. 1 is a schematic sectional view of an example of liquid crystal device to which the driving method according to the invention is applied.
Figure 2:
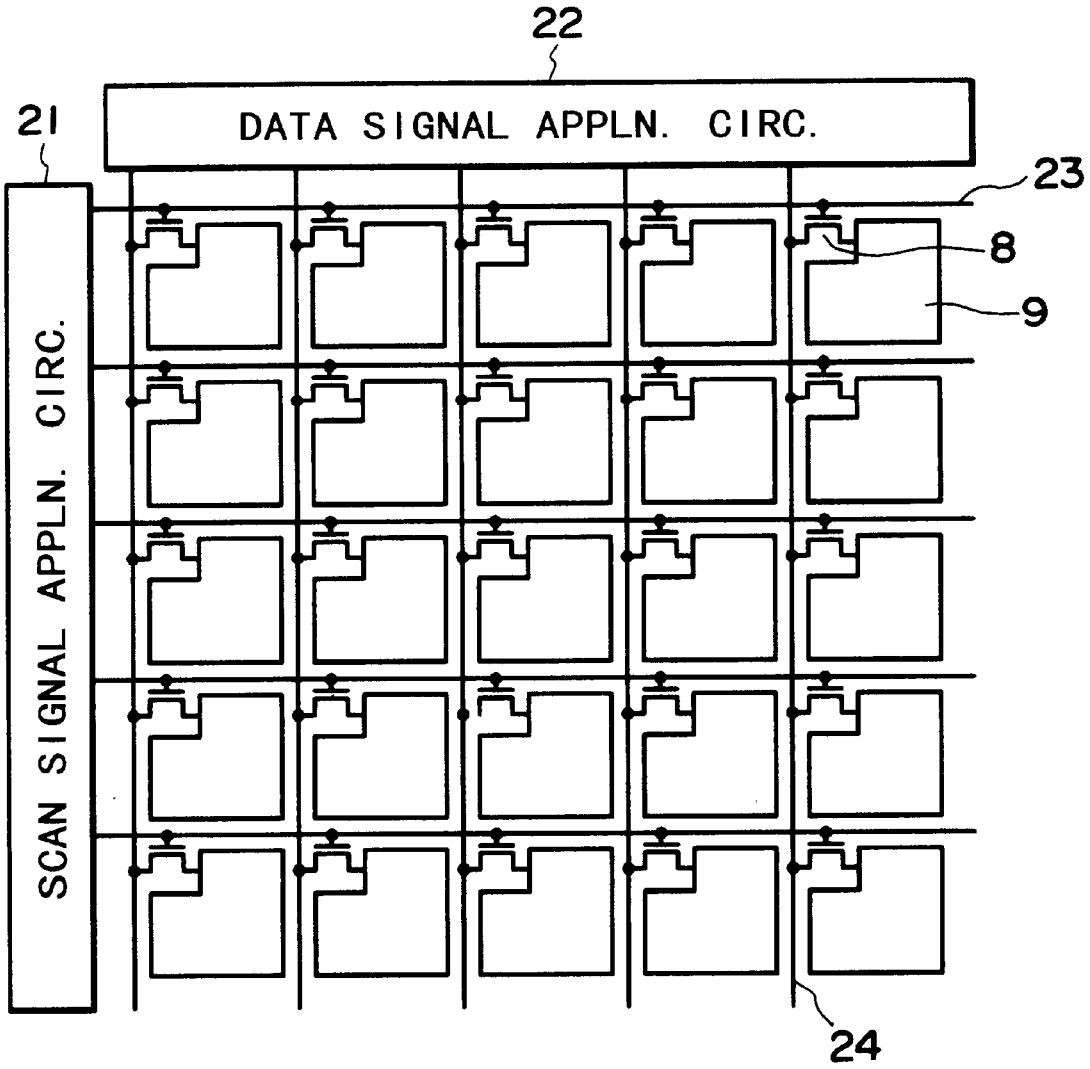
FIG. 2 is a schematic plan view of a liquid crystal display apparatus including the liquid crystal device of FIG. 1.

FIG. 1 is a schematic sectional view of an active matrix-type liquid crystal device to be driven by a driving method according to the present invention, and FIG. 2 is a schematic plan view of a liquid crystal display apparatus incorporating the liquid crystal deice of FIG. 1.

Referring to FIGS. 1 and 2, the liquid crystal device includes a pair of substrates 1 and 2 and a liquid crystal 15 disposed between the substrates in a space surrounded by a sealing member 16. The substrates 1 and 2 are ordinarily formed of an insulating transparent sheet, such as a glass sheet. On the substrate 1, pixel electrodes 9 and TFTs 8 as switching devices are disposed in a two-dimensional matrix.

Each pixel electrode 9 is formed of a transparent electroconductive material, such as ITO (indium tin oxide) and has an area of, e.g., 200–100 $\mu$m×200–100 $\mu$m. Each TFT 8 comprises a gate electrode 3 formed on the substrate 1, a gate insulating film 5 coating the gate electrode 3 and comprising silicon nitride (SiN), etc., a semiconductor layer 4 formed on the gate insulating film 5 so as to be opposite to the gate electrode 3, a source electrode 7 connected to one side of the semiconductor layer 4, and a drain electrode 6 connected to the other side of the semiconductor layer 4. TFT 8 is turned on to have an ON-resistance $R_{ON}$ of ca. 100 kΩ, for example, when the gate electrode 3 is supplied with a gate pulse (scanning selection signal).

The gate electrode 3 of TFT 8 at each pixel is connected to a scanning signal line 23 of a corresponding row, the drain electrode 6 is connected to a corresponding pixel electrode 9, and the source electrode 7 is connected to a data signal line of a corresponding column. Further, each scanning signal line 23 is connected to a scanning signal application circuit 21, and each data signal line 24 and holding capacitor (supplementary capacitor) electrode of ITO film are connected to a data signal application circuit 22. The scanning signal application circuit 21 sequentially supplies a scanning selection signal to the respective scanning signal lines 23 for turning on the gates of TFTs 8 on each line. The data signal application circuit 22 applies gradation pulses having absolute values corresponding to gradation levels to be displayed at the pixels to the corresponding data signal line 24. The pixel electrodes 9 and TFTs 8 are coated with an alignment film 12.

On the substrate 2, a common electrode 13 is disposed opposite to the pixel electrodes 9 so as to be supplied with a reference voltage Vcom, and an alignment film 14 is formed thereon. The common electrode 13 is formed of a transparent conductive material such as ITO.

The alignment films 12 and 14 may be formed of, e.g., a polyimide-based homogeneous alignment material, and the surface thereof may be subjected to an aligning treatment, such as rubbing in prescribed directions.

In a specific example, silica beads of 2.0 $\mu$m in average diameter were dispersed on one substrate so as to provide a uniform cell gap between the substrates 1 and 2, and 200 scanning signals 23 and 960 data signal lines 24 were formed on the substrate 1 so as to provide a color liquid crystal device having a diagonal picture area size of 6 inches and 320×200 pixels each comprising sub-color pixels of R, G and B.

The liquid crystal device constituted may be sandwiched between a pair of polarizers so as to provide a transmission-type display device.

The above-described liquid crystal device structure is just an example, and the driving method of the present invention is applicable to any active matrix-type liquid crystal device capable of controlling a voltage applied to the liquid crystal at each pixel by means of a switching device and having a desired voltage-transmittance characteristic.

The liquid crystal suitably used in the present invention is one having a spontaneous polarization. The liquid crystal material and device arrangement may suitably be designed to provide the liquid crystal 15 with a desired voltage-transmittance characteristic such that the liquid crystal 15 assumes a first alignment state exhibiting a first transmittance under no electric field, is realigned or tilted from the first alignment state to a second alignment state in one direction when supplied with a voltage of a first polarity to exhibit a second transmittance at a prescribed voltage $V_0$, and is realigned or tilted from the first alignment state to a third alignment state in another directions when supplied with a voltage of a second polarity opposite to the second polarity to exhibit a second transmittance at a prescribed voltage $-V_0$, and the liquid crystal 15 changes its transmittance continuously between the first transmittance and the second transmittance depending on a voltage applied thereto. More specifically, it is preferred to use a thresholdless antiferroelectric liquid crystal (herein sometimes abbreviated as "TLAFLC") as described above or a ferroelectric liquid crystal showing such a voltage-transmittance characteristic. Hereinbelow, an embodiment using TLAFLC is described.

Figure 3:
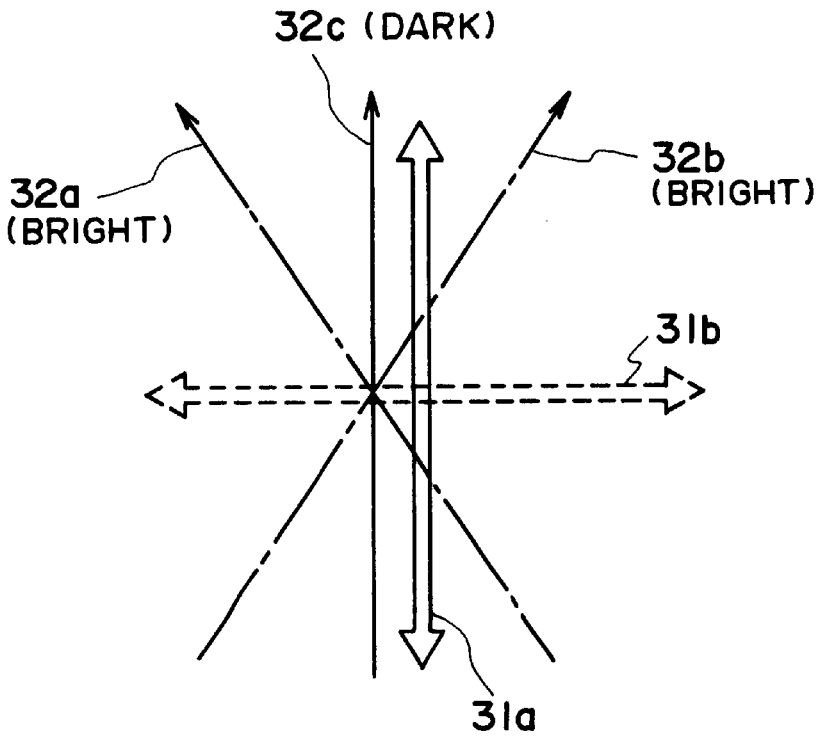
FIG. 3 illustrates a relationship between an average molecular axis direction of liquid crystal molecules and polarization axes of polarizers in a liquid crystal device using TLAFLC (threshold anti-ferroelectric liquid crystal) used in the invention.
Figure 4:
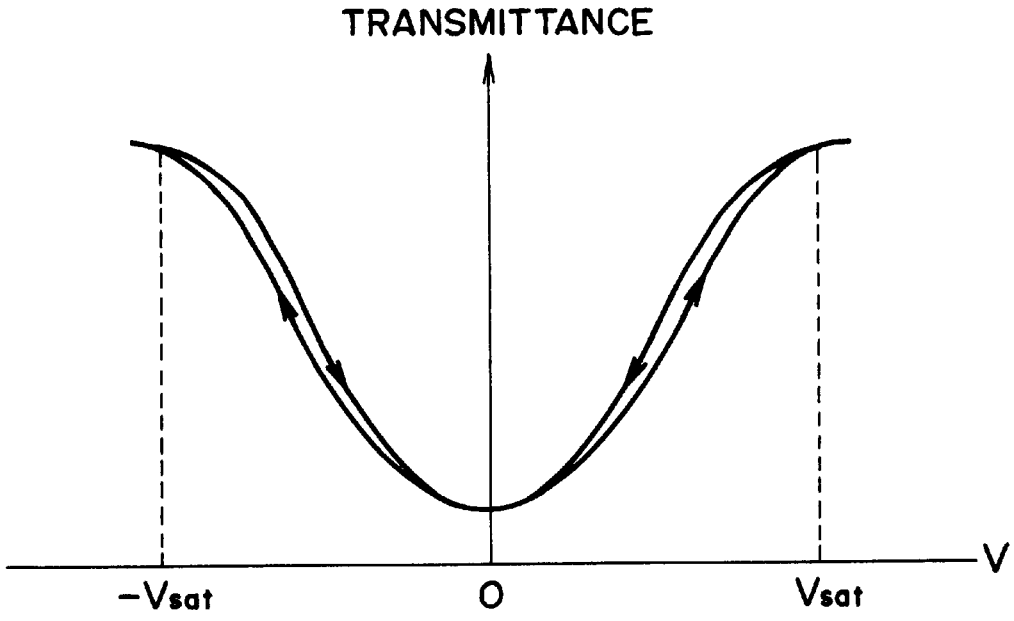
FIG. 4 is a graph showing a voltage-transmittance curve of a liquid crystal device used in the invention.

FIG. 3 illustrates a relationship between several average molecular axis directions of TLAFLC molecules and polarization axes of polarizers, and FIG. 4 illustrates a voltage-transmittance characteristic, respectively, of a TLAFLC device used in the present invention. TLAFLC is sealed between the substrates with a gap smaller than the helical pitch thereof, so that its helical structure is lost. Referring to FIG. 3, when the liquid crystal device is supplied with a voltage of one polarity having an absolute value exceeding a saturation voltage Vsat, all the molecular (longer) axes are oriented to a second direction 32*a* and the dipole moments of all the liquid crystal molecules are uniformized to exhibit a ferroelectric phase. Then, when a voltage of the other polarity having an absolute value exceeding Vsat is applied, the molecular (longer) axes of substantially all the liquid crystal molecules are oriented to a third direction 32*b*, thus also providing a ferroelectric phase. On the other hand, if the application voltage is zero, the liquid crystal molecules are disposed in smectic layers and alternately oriented in the second direction 32*a* or the third direction 32*b* layer by layer, so that the spontaneous polarizations of the respective layers are canceled with each other to provide an antiferroelectric phase. In this state, the average direction (director) of the liquid crystal molecular (longer) axes are aligned substantially in a direction of the smectic layer normal of the liquid crystal, i.e., a first direction 32*c* which is substantially intermediate the second direction 32*a* and the third direction 32*b*.

In combination with the above-mentioned orientation directions of the ATAFLC molecules shown in FIG. 3, a pair of polarizers are disposed so that a transmission axis 31*a* of one polarizer is disposed in substantially parallel to the smectic layer normal direction, and a transmission axis 31*b* of the other polarizer is disposed perpendicular to the transmission axis 31*a*.

If the transmission axes 31*a* and 31*b* are disposed as shown in FIG. 3, the liquid crystal device exhibits the highest transmittance (the brightest display state) in the second or third alignment state wherein the liquid crystal director is oriented in the second or third direction 32*a* or 32*b*, and the lowest transmittance (the darkest display state) in the first alignment state wherein the liquid crystal director is oriented in average in the intermediate direction 32*c* which is substantially parallel to the smectic layer normal.

The director of the liquid crystal is continuously changed between the second direction 32*a* and the third direction 32*b* depending on the polarity and voltage value (absolute value) of the applied voltage. Accordingly, in the liquid crystal device, the transmittance of each pixel can be continuously changed by controlling the voltage applied to the liquid crystal thereat. Incidentally, if the set positions of the polarization axes of the polarizers are changed, it is possible to set a maximum transmittance at an applied voltage of zero and a minimum transmittance at a voltage exceeding the saturation voltage.

Figure 5:
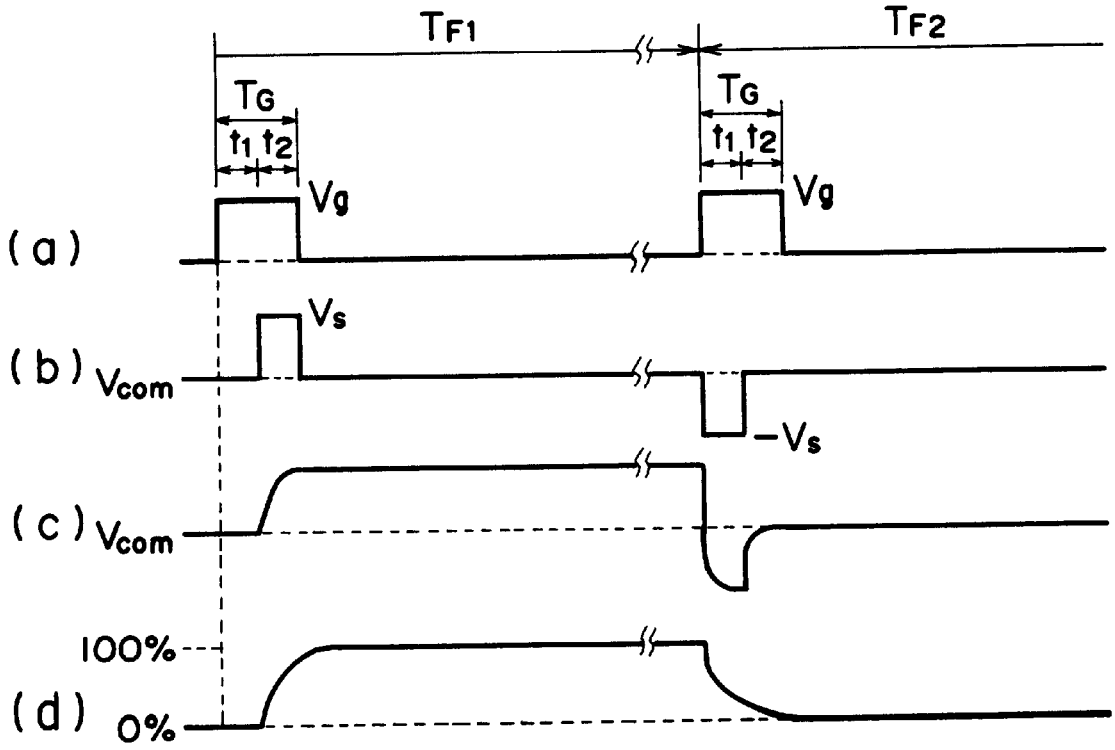
FIG. 5 is a time chart according to a first embodiment of the invention.
Figure 6:
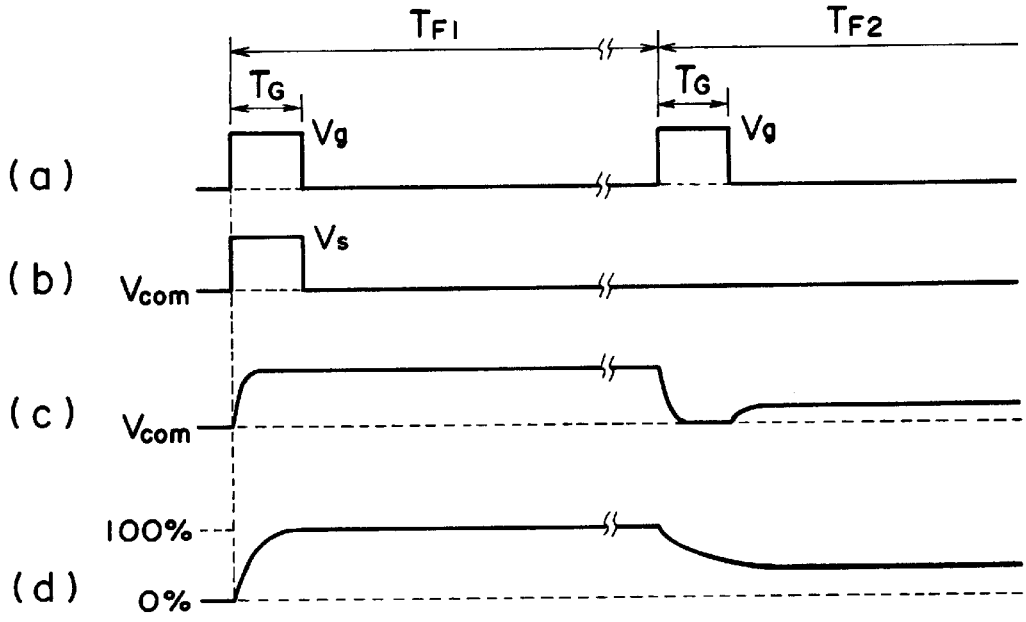
FIG. 6 PRIOR ART
FIGS. 6 and 7 are respectively a time chart for a conventional driving method for a liquid crystal device using TLAFLC.

FIG. 5 is a time chart for practicing a first embodiment of the driving method according to the present invention. Incidentally, with respect to data signal voltage waveforms shown in FIGS. 5–12, only a data signal synchronized with a noted scanning signal line is shown and other data signals are omitted from showing for the convenience of illustration.

Referring to FIG. 5, at (a) is shown a scanning selection signal voltage waveform applied to pixels on an arbitrary line, at (b) is shown a data signal voltage waveform applied to one of the pixels on the line, at (c) is shown a voltage waveform applied to the liquid crystal at the pixel, and at (d) is shown a corresponding transmittance change at the pixel wherein the brightest transmittance level is denoted as 100% and the darkest transmittance level is denoted as 0%. This embodiment adopts a frame inversion drive scheme wherein the polarity of a writing voltage applied to a pixel for display is inverted for each frame.

In a liquid crystal device having a voltage-transmittance characteristic as shown in FIG. 4, for rewriting of an arbitrary pixel, a longer time is required for rewriting from a bright state to a dark state than rewriting from the dark state to the bright state. This is because the former rewriting utilizes the force of liquid crystal molecules returning to their stable state when the voltage applied thereto is reduced or made zero as a driving force.

As shown in FIG. 5, in the present invention, a scanning selection period is divided into sub-periods $t_1$ and $t_2$ (which are equal to each other in this embodiment), and in the period $t_1$, a reset pulse of a polarity opposite to that of a writing pulse voltage applied in a previous frame is applied to the liquid crystal to provide a 0%-display state during the period $t_1$. More specifically, in case where a writing voltage pulse of a positive polarity is applied in a previous frame $T_{F1}$ for providing a 100%-display state, a reset pulse of a negative polarity is applied. Liquid crystal molecules supplied with the reset pulse of an opposite polarity are switched toward the opposite direction (i.e., from 32*a* toward 32*b*, or from 32*b* toward 32*a* in FIG. 3), so that the rewriting can be performed at a faster speed than when the voltage applied to the liquid crystal is simply made zero, thus within a period $t_1$ which is much shorter than the period $T_G$ shown in FIG. 7. In the period $t_2$, a writing pulse corresponding to a desired display state in a frame $T_{F2}$ is applied so as to effect a rewriting from the dark state to a bright state, which is fast by nature. Accordingly, a sufficient rewriting is effected within a selection period $T_G$ which is much shorter than that required in the conventional scheme, so that a time for effectively displaying a desired gradation level within one frame is extended to effect an accurate gradational display.

Figure 8:
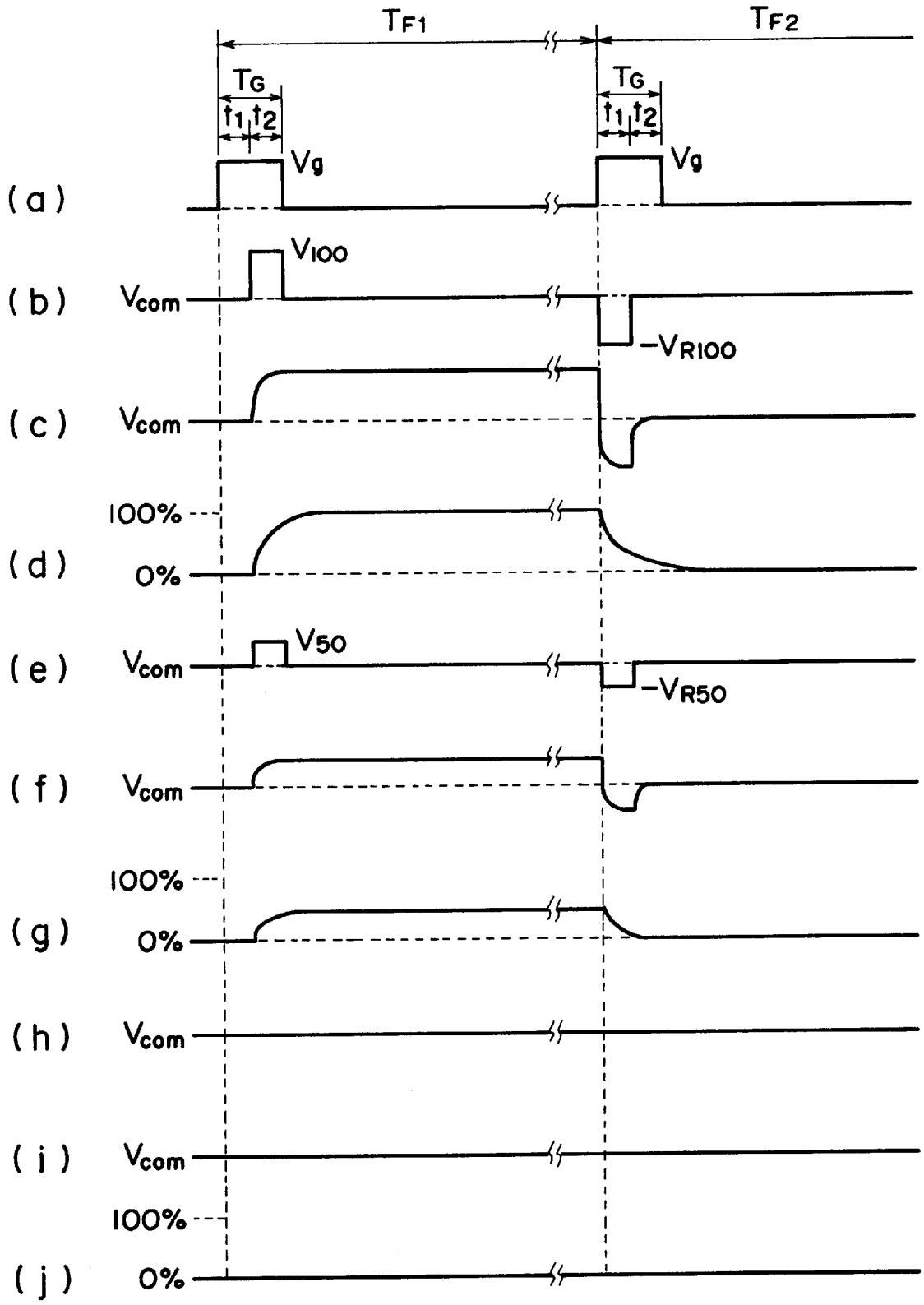
FIG. 8 is a time chart for illustrating a manner of setting a reset pulse in the first embodiment of the invention.
Figure 10:
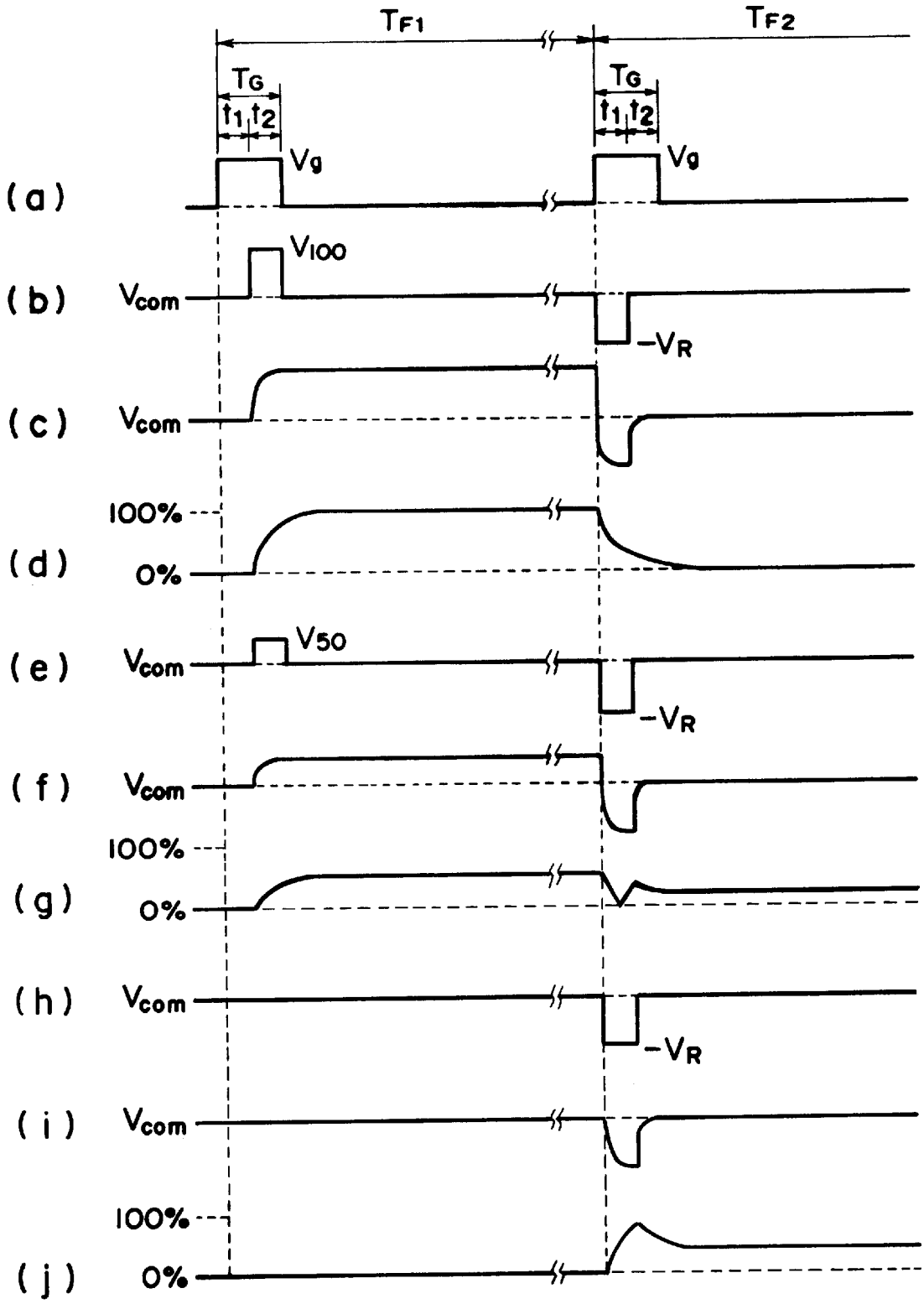
FIG. 10 is a time chart for illustrating a case of applying reset pulses of an identical voltage value to pixels having displayed different gradation levels.

Now, a method of setting a specific value of reset pulses will be described with reference to FIG. 8. As described with reference to FIG. 4, the liquid crystal device according to this embodiment exhibits a minimum transmittance when a voltage of zero is applied to the liquid crystal and also transmittances which increase depending on absolute values of voltages applied to the liquid crystal. Accordingly, if an excessively large value of reset voltage is applied, the liquid crystal can pass through a 0%-display state to reach a bright display state within the period $t_1$. This phenomenon is illustrated in FIG. 10. Referring to FIG. 10, at (a) is shown a scanning selection signal voltage waveforms applied to data signal lines each connected to one of the pixels on the line; at (b), (e) and (h) are shown data signal voltage waveforms applied to data signal lines each connected to one of the pixels on the line; at (c), (f) and (i) are shown voltage waveforms applied to the liquid crystal at the corresponding pixels; and at (d), (g) and (j) are shown resultant transmittance changes at the respective pixels. Further, the waveforms at (b)–(d) represent a case of 100%-display, the waveforms at (e)–(g) represent a case of 50%-display and the waveforms at (h)–(j) represent a case of 0%-display, respectively in a first frame $T_{F1}$. In any cases, a 0%-display is intended in a second frame $T_{F2}$.

In case where pixels having formed 0%, 50% and 100%-display states are supplied with reset pulses of an identical voltage value $-V_R$ as shown in FIG. 10 at (b), (e) and (h), respectively, the pixel of 100% display assumes a substantially 0%-display state after the period $t_1$ as shown at (d), but the pixels of 50%-display and 0%-display cause overswitching by the reset pulses and pass through the intended 0%-display state to reach bright display states showing a transmittance exceeding 0%. Thus, some pixels can fail to display an intended 0%-display state.

Accordingly, in the present invention, the voltage value of a reset pulse is selected depending on a display state in a previous frame $T_{F1}$. More specifically, as shown in FIG. 8, a pixel having exhibited a 100%-display state in a previous frame $T_{F1}$ is supplied with a reset pulse having a voltage value $-V_{R100}$ which has an opposite polarity and an identical absolute value to a writing pulse voltage value of $V_{100}$ for the 100%-display in the period $t_1$ of a subsequent frame $T_{F2}$ as shown at (b). Moreover, pixels having a 0%-display state and an intermediate 50%-display state are supplied with a reset pulse of voltage zero and a reset pulse of $-V_{R50}$ which has an opposite polarity and an identical absolute value to the intermediate voltage $V_{50}$ for the intermediate 50%-display state, respectively in the period $t_2$ of $T_{F2}$, thereby providing substantially 0%-display state without overswitching to a bright display state.

Figure 9:
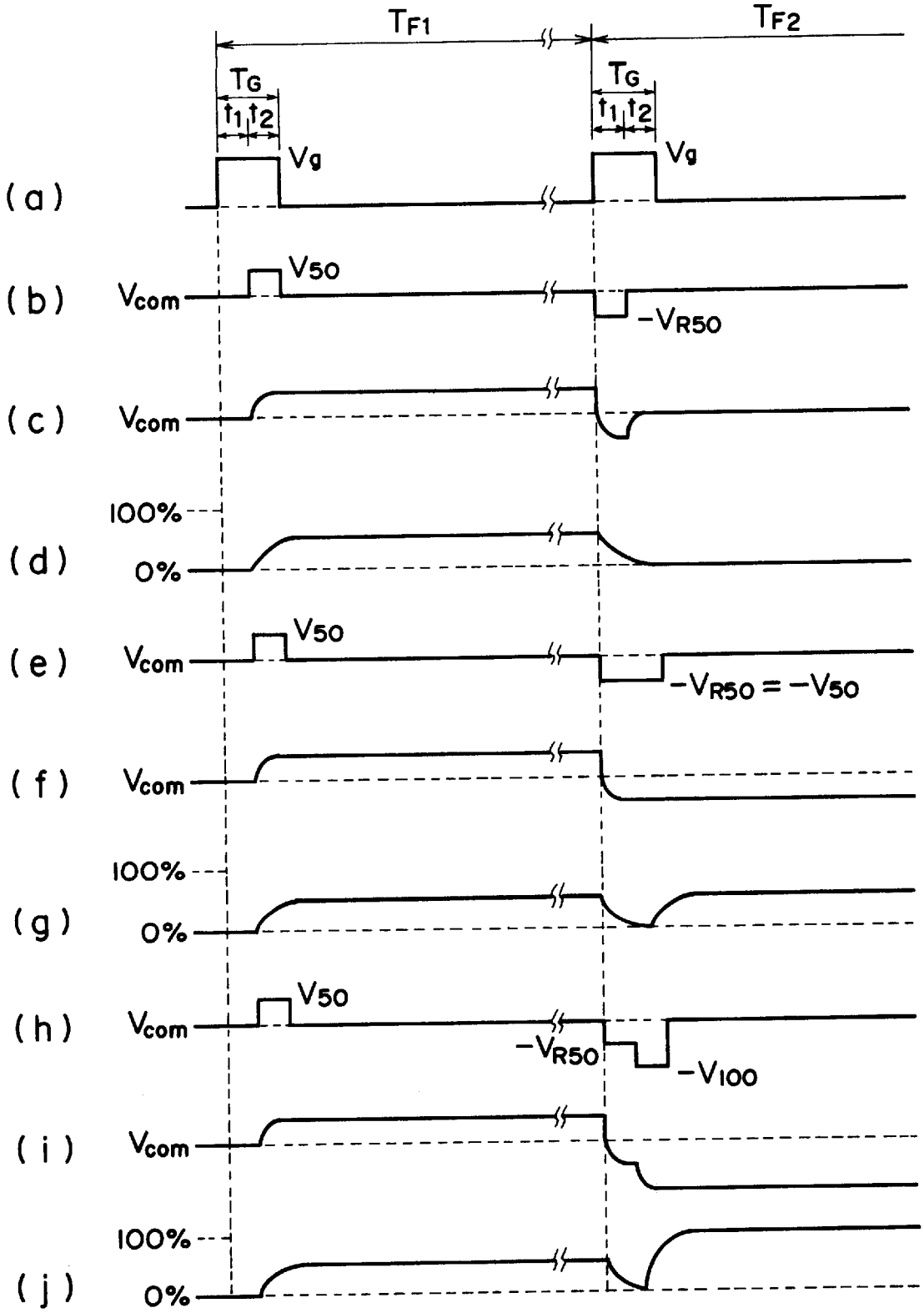
FIG. 9 is a time chart for illustrating a manner of rewriting a 50%-display pixel into 0–100% display states in the first embodiment of the invention.

FIG. 9 is a time chart for illustrating a case of rewriting pixels each having exhibited a 50%-display state into 0%-, 50%- and 100%-display states, respectively. Referring to FIG. 9, at (a) is shown a scanning selection signal voltage waveform applied to pixels on an arbitrary line; at (b), (e) and (h) are shown data signal voltage waveforms applied to data signal lines each connected to one of the pixels on the line; at (c), (f) and (i) are shown voltage waveforms applied to the liquid crystal at the corresponding pixels; and at (d), (g) and (j) are shown resultant transmittance changes at the respective pixels. The waveforms at (b)–(d) represent a case of 0%-display, the waveforms at (e)–(g) represent a case of 50%-display, and the waveforms at (h)–(j) represent a case of 100%-display, respectively in a second frame $T_{F2}$.

In any cases, the pixels having exhibited a 50%-display state in $T_{F1}$ are supplied with reset pulses corresponding to the writing pulse of $V_{50}$ for providing the 50%-display state, i.e., pulses of $-V_{R50}$ having an opposite polarity and an identical absolute value with respect to the writing pulse of $V_{50}$ (i.e., $-V_{R50}$=ca. $-V_{50}$), in the period $t_1$ of $T_{F2}$, and writing pulses having voltages corresponding to the 0%-50%- and 100%-display states, respectively, in the period $t_2$ of $T_{F2}$.

This embodiments has been explained with reference to a frame-inversion drive scheme wherein the polarity of a writing voltage applied to a pixel for display is inverted for each frame, but this embodiment is also applicable to a scheme free from polarity inversion of writing pulses or a scheme wherein polarity inversion of writing pulses is effected in every plurality of frames.

Figure 11:
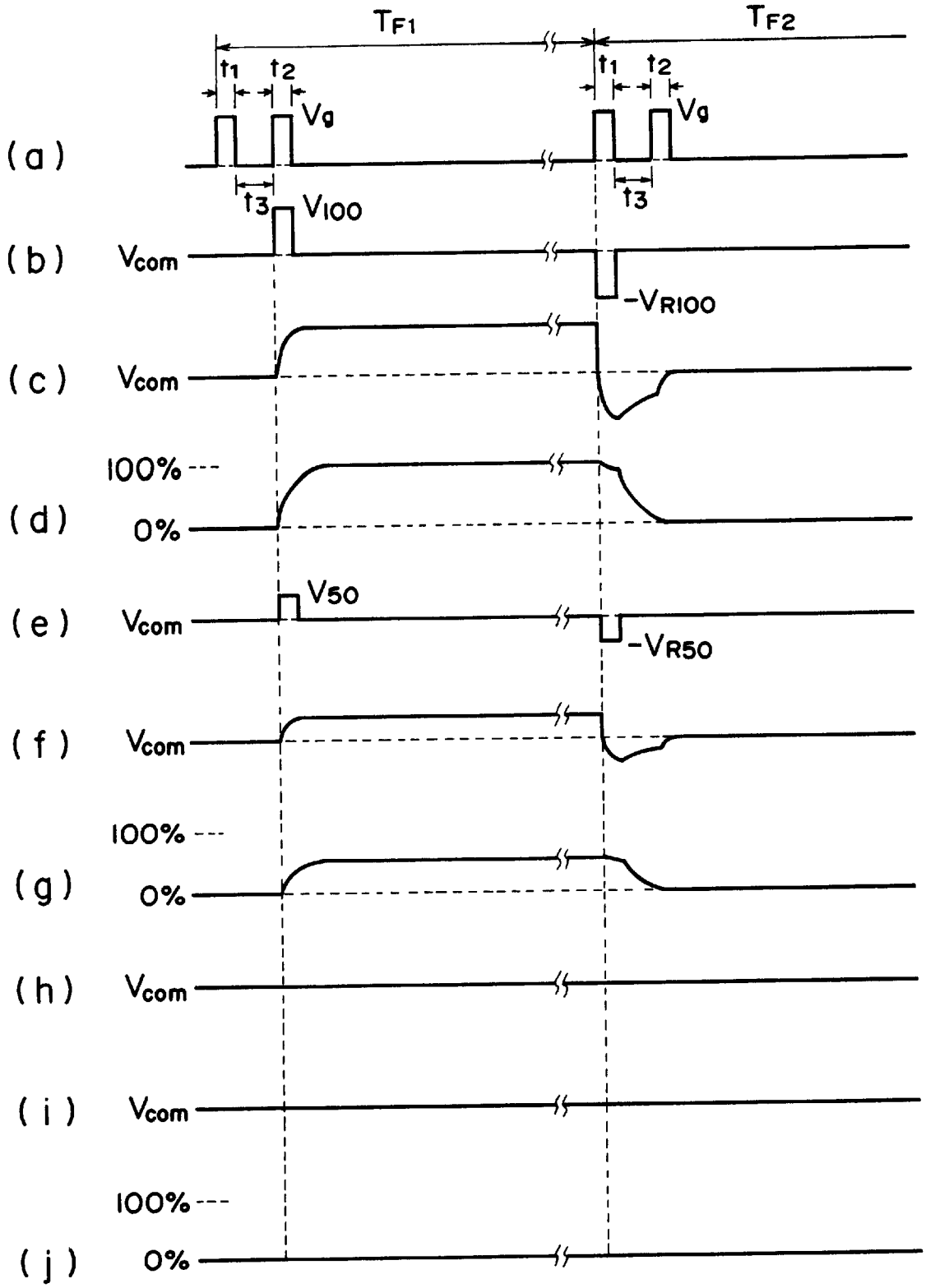
FIG. 11 is a time chart according to a second embodiment of the invention.

Next, a second embodiment of the driving method according to the present invention will be described. This embodiment aims at rewriting with a shorter selection period than in the first embodiment. FIG. 11 is a time chart therefor. Referring to FIG. 11, at (a) is shown a scanning selection signal voltage waveform applied to pixels on an arbitrary line; at (b), (e) and (h) are shown data signal voltage waveforms applied to data signal lines each connected to one of the pixels on the line; at (c), (f) and (i) are shown voltage waveforms applied to the liquid crystal at the corresponding pixels; and at (d), (g) and (j) are shown resultant transmittance changes at the respective pixels. The waveforms at (b)–(d) represent a case of 100%-display, the waveforms at (e)–(g) represent a case of 50%-display, and the waveforms at (h)–(j) represent a case of 0%-display, respectively in a first frame $T_{F1}$. In case cases, a 0%-display state is intended to be formed.

In this embodiment, a non-selection period $t_3$ is interposed between divided scanning selection periods $t_1$ and $t_2$. In the period $t_1$, similarly as in the first embodiment, a reset pulse determined depending on a display state in a previous frame of a pixel is applied to the pixel to reset the pixel into a 0%-display state. In order to provide a time for resetting the pixel into the 0%-display state, a TFT for a selected line is once turned off after the period $t_1$ to maintain the application of a reset pulse voltage to the pixels on the selected for a period $t_3$ necessary for completing the resetting of the periods into the 0%-display state. After resetting into the 0%-display state, the TFT is again turned on for a period $t_2$ to apply writing pulse voltages to the pixels on the selected line. The non-selection period $t_3$ between the scanning selection period $t_1$ and $t_2$, can be used for scanning selection of another line or other lines so that a selection period for one line can be substantially reduced to provide an increased frame frequency.

Also this embodiments has been explained with reference to a frame-inversion drive scheme wherein the polarity of a writing voltage applied to a pixel for display is inverted for each frame, but this embodiment is also applicable to a scheme free from polarity inversion of writing pulses or a scheme wherein polarity inversion of writing pulses is effected in every plurality of frames.

Figure 12:
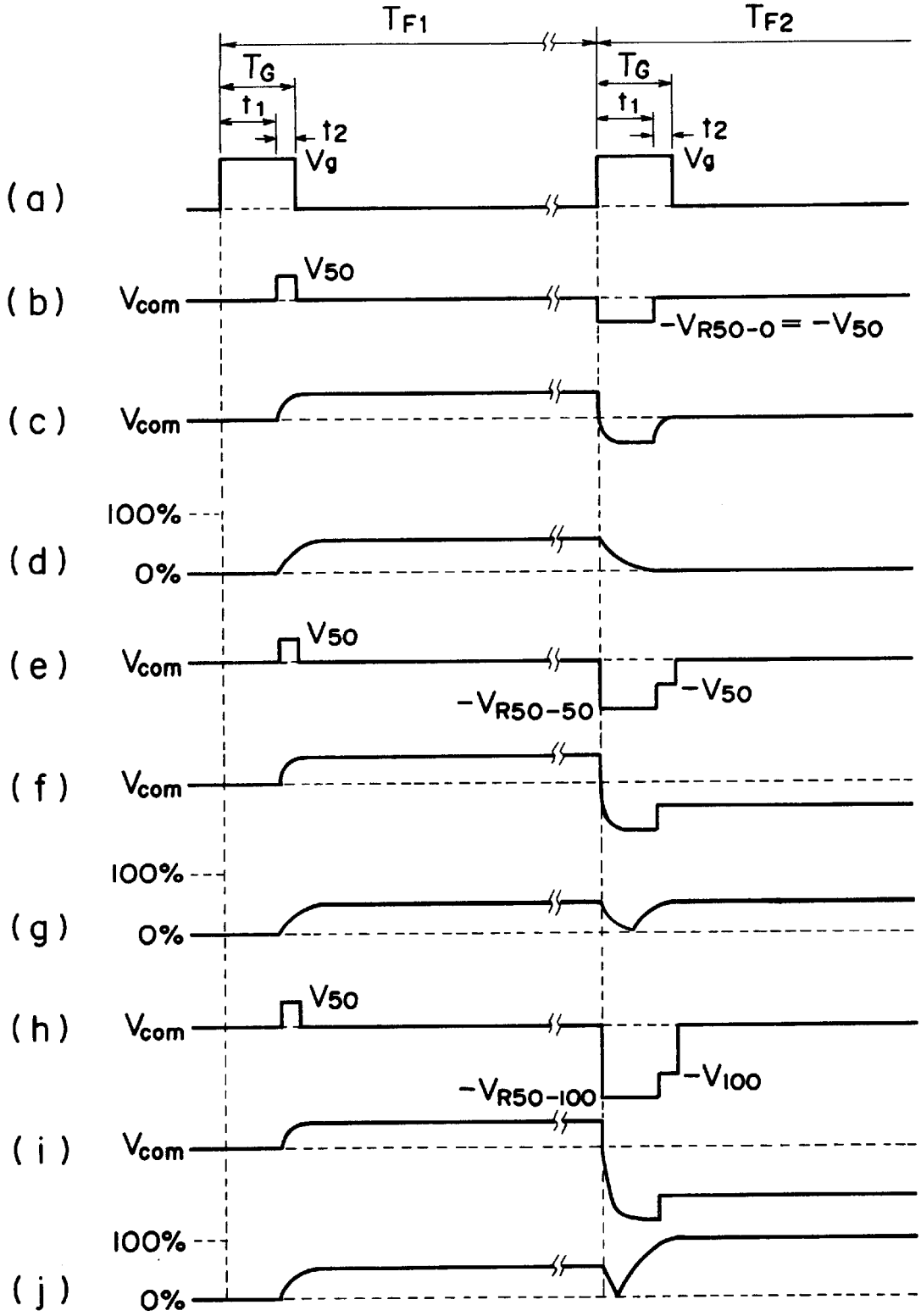
FIG. 12 is a time chart according to a third embodiment of the invention.

Next, a third embodiment of the driving method according to the present invention will be described, which is capable of effectively shortening the scanning selection period $t_G$ to provide an increased frame frequency similarly as in the second embodiment. FIG. 12 is a time chart for this embodiment. Referring to FIG. 12, at (a) is shown a scanning selection signal voltage waveform applied to pixels on an arbitrary line; at (b), (e) and (h) are shown data signal voltage waveforms applied to data signal lines each connected to one of the pixels on the line; at (c), (f) and (i) are shown voltage waveforms applied to the liquid crystal at the corresponding pixels; and at (d), (g) and (j) are shown resultant transmittance changes at the respective pixels. The waveforms at (b)–(d) represent a case of 0%-display, the waveforms at (e)–(g) represent a case of 50%-display, and the waveforms at (h)–(j) represent a case of 100%-display, respectively in a second frame $T_{F2}$.

In any cases, the pixels having exhibited a 50%-display state in $T_{F1}$ are supplied with reset pulses which are determined based on a display state formed in a previous frame and a display state to be formed in a current frame of the respective pixels. As has been explained with reference to the first embodiment, if a reset pulse having an excessively large voltage value is applied, the relevant pixels are caused to pass through a 0%-displays state to provide a bright state exhibiting a transmittance exceeding 0%. In this embodiment, this characteristic is rather utilized to determine a reset pulse by adding a voltage value for providing a display state in a current frame to a voltage value set with reference a display state attained in the previous frame, thereby rewriting the pixel concerned into a display state closer to the one intended to be formed in the current frame.

More specifically, with reference to FIG. 12, in case where a 0%-display state is to be formed in a current frame $T_{F2}$ as shown at (d), a reset pulse having a voltage value ($-V_{R50}$) determined corresponding to a previous display state of 50% is applied in the period $t_1$ similarly as in the first embodiment. In case of rewriting from the same 50%-display state, however, if a 50%-display state is to be formed in a current frame as shown at (g), the reset pulse therefor is determined by adding a writing pulse voltage value ($-V_{50}$) for a 50%-display state to a reset voltage value ($-V_{R50}$) so as to reset the pixel to a 0%-display state in an early period within the period $t_1$ and further start the rewriting to a bright state within the period $t_1$. Then, in a subsequent writing period $t_2$, a writing pulse having a voltage value ($-V_{50}$) for a prescribed 50%-display state is applied to hold the pixel already having an increased transmittance at the 50%-display level. Similarly, in case where a pixel is rewritten from a 50%-display state to a 100%-display state as shown at (j), the reset pulse voltage value is determined by adding a writing pulse voltage value ($-V_{100}$) for a 100%-display to a reset voltage value ($-V_{R50}$) so as to reset the pixel to a 0%-display state in an earlier period within the period $t_1$ earlier than in the case of 50%-display and further start the rewriting to a bright state within the period $t_1$. In this case, the reset pulse voltage ($-V_{R50\text{-}100}$) exceeds a saturation voltage necessary for a 100%-display, so that a writing pulse voltage ($-V_{100}$) required for a prescribed 100%-display is applied to the pixel to hold the pixel at the 100%-display level.

In this embodiment, the rewriting into a display state of a current frame is started at a point of time at which the 0%-display state is realized within the period $t_1$, so that the rewriting period $t_2$ can be shortened than in the first embodiment and therefore the one-line scanning selection period can be effectively shortened to provide an increased frame frequency.

Figure 13:
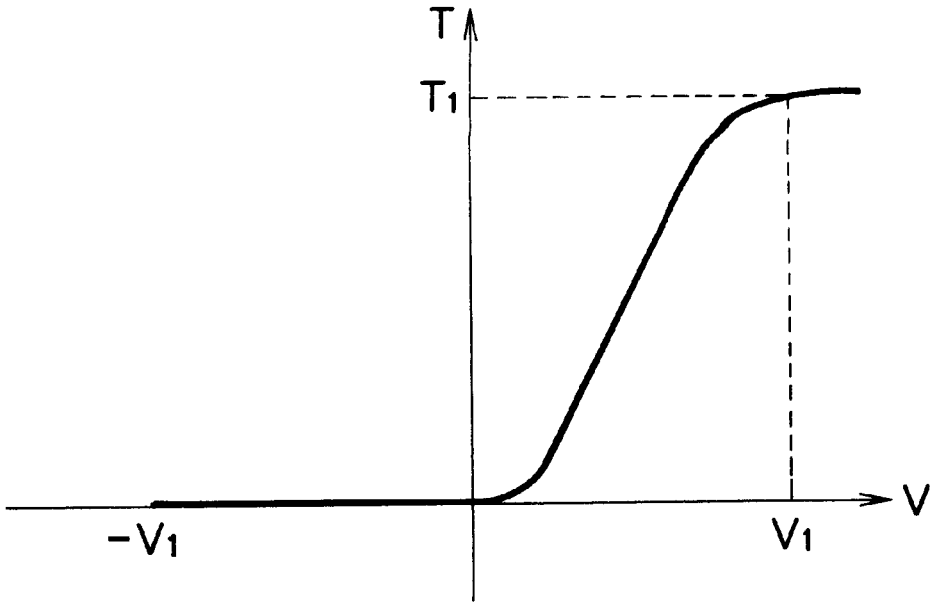
FIGS. 13 and 14 are respectively a graph showing another voltage-transmittance characteristic of a liquid crystal device used in the invention.

A liquid crystal device having a voltage (V)-transmittance (T) characteristic as shown in FIG. 13 can also be driven according to the first third embodiments of the driving method according to the present invention explained with reference to FIGS. 8 and 9, FIG. 11, and FIG. 12, respectively, to attain similar effects as obtained by using a liquid crystal device having a voltage (V)-transmittance (T) characteristic as shown in FIG. 4.

A liquid crystal device having a V-T characteristic shown in FIG. 13 can be formed by using a liquid crystal material exhibiting a chiral smectic phase, of which the composition is adjusted to preferably contain at most 50 wt. % of compounds having an ester skeleton, and further by appropriate adjustment of the liquid crystal material treatment, the device structure including a material, and a treatment condition for alignment control films. More specifically, the V-T characteristic of FIG. 13 is realized by a liquid crystal device wherein the liquid crystal molecules are aligned to provide an average molecular axis substantially coinciding with an average uniaxial aligning treatment axis to be monostabilized in the absence of an electric field applied thereto and, under application of voltages of one polarity (a first polarity), are realigned to provide a tilt angle which varies continuously from the average molecular axis of the monostabilized position depending on the magnitude of the applied voltage, but under application of voltages of the other polarity (i.e., a second polarity opposite to the first polarity), the liquid crystal molecules are not substantially tilted but provide an average molecular axis substantially coinciding with the average molecular axis under no electric field regardless of the magnitude of the applied voltages. The liquid crystal material showing a chiral smectic phase may preferably exhibit a phase transition series on temperature decrease of I (isotropic) phase—Ch (cholesteric) phase—SmC* (chiral smectic) phase or I phase—SmC* phase and be placed in a non-memory state in the SmC* phase.

Figure 14:
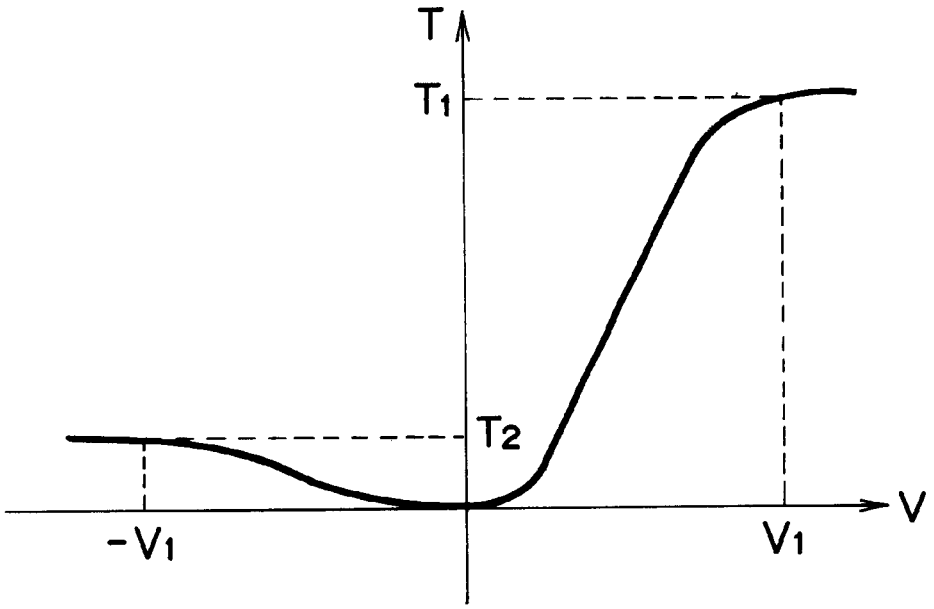

Further, a liquid crystal device having a voltage (V)-transmittance (T) characteristic as shown in FIG. 14 can also be driven according to the first to third embodiments of the driving method according to the present invention explained with reference to FIGS. 8 and 9, FIG. 11, and FIG. 12, respectively, to attain similar effects as obtained by using a liquid crystal device having a voltage (V)-transmittance (T) characteristic as shown in FIG. 4.

A liquid crystal device having a V-T characteristic shown in FIG. 14 can be formed by using a liquid crystal material exhibiting a chiral smectic phase, while adjusting the composition thereof, and further by appropriate adjustment of the liquid crystal material treatment, the device structure including a material, and a treatment condition for alignment control films. More specifically, the V-T characteristic of FIG. 14 is realized by a liquid crystal device wherein the liquid crystal molecules are aligned to provide an average molecular axis substantially coinciding with an average uniaxial aligning treatment axis to be mono-stabilized in the absence of an electric field applied thereto and, under application of voltages of one polarity (a first polarity), are realigned to provide a tilt angle which varies continuously from the average molecular axis of the monostabilized position depending on the magnitude of the applied voltage. On the other hand, under application of voltages of the other polarity (i.e., a second polarity opposite to the first polarity), the liquid crystal molecules are tilted from the average molecular axis under no electric field depending on the magnitude of the applied voltages, but the maximum tilt angle obtained under application of the second polarity voltages is substantially smaller than the maximum tilt angle formed under application of the first polarity voltages. The liquid crystal material showing a chiral smectic phase may preferably exhibit a phase transition series on temperature decrease of I (isotropic) phase—Ch (cholesteric) phase—SmC* (chiral smectic) phase or I phase—SmC* phase and be placed in a non-memory state in the SmC* phase.

EXAMPLES

A liquid crystal device having an organization as shown in FIGS. 1 and 2 and including 200 scanning lines was prepared and driven by the driving method according to the present invention. The liquid crystal used was prepared by mixing 20 wt. % of a mesomorphic compound of formula (1) below and 80 wt. % of a mesomorphic compound of formula (2) below:

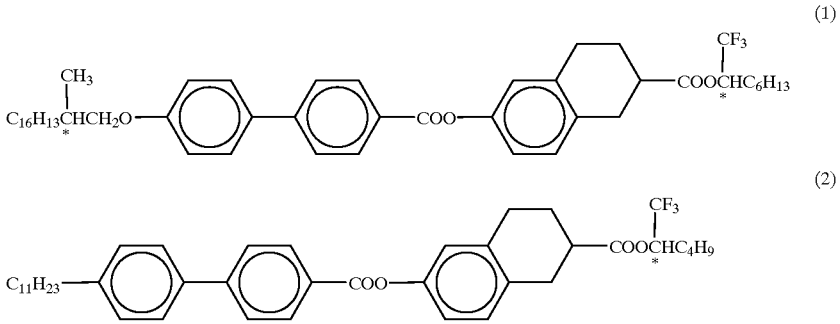

The liquid crystal exhibited a spontaneous polarization at 72° C. of 56 nC/cm$^2$ as measured according to K. Miyasato, et al, "Direct Method with Triangular Waves for Measuring Spontaneous Polarization in Ferroelectric Liquid Crystal", Japan.

J. Appl. Phys. 22, No. 10, L661 (1983).

Figure 7:
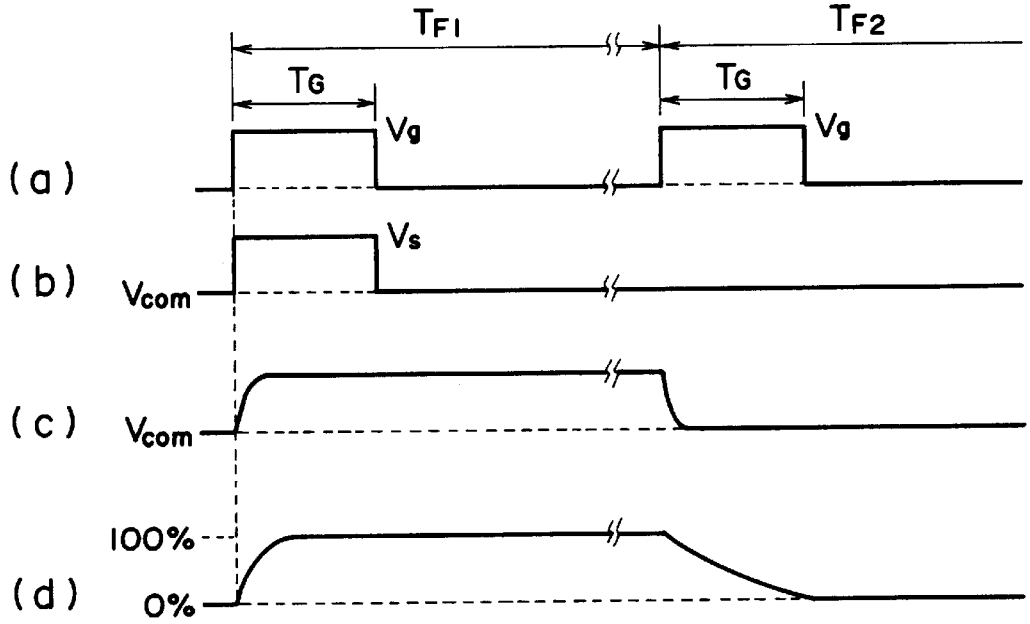
FIG. 7 PRIOR ART

The liquid crystal device was driven by a conventional method as represented by the time chart of FIG. 7 wherein the gate voltage was set at Vg=6 volts, a data signal voltage for 100%-display was set at Vs=$V_{100}$=6 volts, a data signal voltage for 50%-display was set at $V_s$=$V_{50}$=3 volts and a data signal voltage for 0%-display was set at $V_S$=$V_0$=0 volt. As a result, 250 μsec was required as a scanning selection period $T_G$ for achieving a conversion from 100%-display to 0%-display, so that a frame period ($T_{F1}$) amounted to 50 msec (=0.25×200).

Then, the liquid crystal device was driven according to the first embodiment of the driving method represented by FIG. 9 wherein the respective parameters were set as follows: Vg=6 volts, $t_1$=$t_2$=60 μsec. $F_{F1}$=$T_{F2}$=($t_1$+$t_2$)×200=24 msec, $V_{100}$=6 volts, $V_{50}$=3 volts, $V_0$=Vcom=0 volt, $V_{R100}$ (reset pulse voltage from 100%-display)=6 volts, $V_{R50}$ (reset pulse voltage from 50%-display)=3 volts, and $V_{R0}$ (reset pulse voltage from 0%-display)=Vcom=0 volt. As a result, a good gradational display was effected.

Also, the liquid crystal device was driven according to the second embodiment of the driving method of the present invention represented by FIG. 11 wherein the respective parameters were set as follows: $t_1$=$t_2$=10 μsec, $t_3$ (non-selection period between $t_1$ and $t_2$)=20 μsec, $T_{F1}$=$T_{F2}$=4 msec (=($t_1$+$t_2$)×200), $V_{100}$=6 volts, $V_{50}$=3 volts, $V_0$=$V_{R0}$=Vcom=0 volt, $V_{R100}$=6 volts, and $V_{R50}$=3 volts. As a result, a good gradational display similarly as in the driving method of FIG. 9 was effected at a higher frame frequency.

Further, the liquid crystal device was driven according to the third embodiment of the driving method of the present invention represented by FIG. 12 wherein the respective parameters were set as follows: $t_1$=50 μsec, $t_2$=10 μsec, $T_{F1}$=$T_{F1}$=12 msec, $V_{100}$=6 volts, $V_{50}$=3 volts, $V_0$=Vcom=0 volt, and the reset pulse voltages were given as pulses having a polarity opposite to the writing pulse for a previous frame and an absolute value obtained by adding an absolute value of writing pulse voltage for a previous frame and an absolute value of writing pulse voltage for a current frame. For example, the reset pulses shown in FIG. 12 were set as follows: $-V_{R50\text{-}0}$ (a reset pulse voltage for rewriting from 50%-display to 0%-display)=−3 volts, $-V_{R50\text{-}50}$ (a reset pulse voltage for rewriting from 50%-display to 50%-display)=−6 volts, and $-V_{R50\text{-}l00}$ (a reset pulse voltage for rewriting from 50%-display to 100%-display)=−9 volts. As a result, a good gradational display similarly as in the driving method of FIG. 9 was effected at a higher frame frequency.

As described above, according to the present invention, the rewriting of a pixel can be completed in a shorter scanning selection period, so that it becomes possible to effect a higher speed drive or a higher resolution display by increasing the number of pixels. According to the present invention, it becomes possible to further shorten the effective scanning selection period by interposing a non-selection period between a reset pulse-application period and a writing pulse-application period, or by using a reset pulse having an amplitude increased by adding a writing pulse voltage for a current frame display, thereby realizing a higher frame frequency or a higher resolution display.

What is claimed is:

1. A driving method for a liquid crystal device of the active matrix-type comprising a pair of substrates, a layer of liquid crystal having a spontaneous polarization disposed between the substrates so as to form two-dimensionally arranged pixels disposed along a plurality of rows and a plurality of columns, and a switching device disposed at each pixel so as to control a voltage applied to the liquid crystal at the pixel; said driving method comprising a frame operation including:

dividing a scanning selection period for each selected row into a first period and a second period in a current frame, in the first period, applying a reset pulse having an amplitude $V_R$ and a pulse width $t_R$ to the liquid crystal at each pixel on the selected row, said reset pulse having a polarity opposite to that of a writing pulse voltage having an amplitude $V_W$ and a pulse width $t_W$ applied to the liquid crystal at the pixel in a previous frame, thereby resetting the pixels on the selected row to a first transmittance, and in the second period, applying a writing pulse having a prescribed amplitude and a prescribed pulse width to the liquid crystal at each pixel to establish a prescribed transmittance for current frame display at the pixel, wherein the reset pulse in the current frame has an absolute value of a product of the amplitude $V_R$ and the pulse width $t_R$ equal to an absolute value of a product of the amplitude $V_W$ and the pulse width $t_W$ of the writing pulse in the previous frame, at each pixel on the selected row.

2. A driving method according to claim 1, wherein the liquid crystal has alignment characteristic and voltage-transmittance characteristic such that the liquid crystal assumes a first alignment state exhibiting a first transmittance under no electric field, is tilted from the first alignment state to a second alignment state in one direction when supplied with a voltage of a first polarity to exhibit a second transmittance at prescribed voltage $V_0$, and is tilted from the first alignment state to a third alignment state in the other direction when supplied with a voltage of a second polarity opposite to the second polarity to exhibit a second transmittance at a prescribed voltage $-V_0$, and the liquid crystal changes its transmittance continuously between the first transmittance and the second transmittance depending on a voltage applied thereto.

3. A driving method according to claim 1, wherein the liquid crystal has alignment characteristic and voltage-transmittance characteristic such that the liquid crystal assumes a monostable first alignment state exhibiting a first transmittance under no electric field, is tilted from the monostable first alignment state in one direction when supplied with a voltage of a first polarity at a tilt angle which varies depending on magnitude of the supplied voltage thereby providing a second transmittance which also varies continuously depending on magnitude of the supplied voltage, and retains the monostable first alignment state exhibiting the first transmittance when supplied with a voltage of a second polarity opposite to the first polarity.

4. A driving method according to claim 1, wherein the liquid crystal has alignment characteristic and voltage-transmittance characteristic such that the liquid crystal assumes a monostable first alignment state exhibiting a first transmittance under no electric field, is tilted from the monostable first alignment state in one direction when supplied with a voltage of a first polarity at a tilt angle which varies depending on magnitude of the supplied voltage thereby providing a second transmittance which also varies continuously depending on magnitude of the supplied voltage, and is tilted from the monostable first alignment state in the other direction when supplied with a voltage of a second polarity opposite to the first polarity at a tilt angle which varies depending on magnitude of the voltage of the second polarity but provides only a maximum value that is smaller than a maximum tilt angle formed under application of the voltage of the first polarity.

5. A driving method according to claim 1, wherein the polarity of the writing pulse is inverted for each frame.

6. A driving method according to claim 1, wherein the reset pulse for each pixel in the current frame has a voltage value determined based on a display state at the pixel in the previous frame.

7. A driving method according to claim 1, wherein a non-selection period is disposed between the first and second periods for each selected row.

8. A driving method according to claim 1, wherein the reset pulse for each pixel in the current frame has a voltage value determined based on a display state in the previous frame and a display state in the current frame, respectively at the pixel.

9. A driving method according to any of claims 1 and 2–8, wherein the liquid crystal is an anti-ferroelectric liquid crystal.

* * * * *

UNITED STATES PATENT AND TRADEMARK OFFICE

CERTIFICATE OF CORRECTION

PATENT NO. : 6,323,850 B1
DATED : November 27, 2001
INVENTOR(S) : Kazunori Katakura et al.

It is certified that error appears in the above-identified patent and that said Letters Patent is hereby corrected as shown below:

Column 3,
Line 17, "o" should read -- of --; and
Line 41, "to,a" should read -- to a --.

Column 4,
Line 27, "deice" should read -- device --.

Column 5,
Line 36, "directions" should read -- direction --.

Column 6,
Line 11, "ATAFLC" should read -- TLAFLC --.

Column 9,
Line 34, "0%-displays" should read -- 0%-display --.

Signed and Sealed this

Seventh Day of May 2002

*Attest:*

*Attesting Officer*

JAMES E. ROGAN
*Director of the United States Patent and Trademark Office*